US010566768B2

(12) United States Patent
Niessner

(10) Patent No.: US 10,566,768 B2
(45) Date of Patent: Feb. 18, 2020

(54) SPARK PLUG IGNITION TIP, SPARK PLUG DEVICE, AND METHOD FOR PRODUCING A SPARK PLUG IGNITION TIP

(71) Applicant: Federal-Mogul Ignition GmbH, Neuhaus-Schierschnitz (DE)

(72) Inventor: Werner Niessner, Steinheim (DE)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 0 days.

(21) Appl. No.: 16/352,592

(22) Filed: Mar. 13, 2019

(65) Prior Publication Data

US 2019/0288488 A1 Sep. 19, 2019

(30) Foreign Application Priority Data

Mar. 14, 2018 (DE) ..... 10 2018 105 941

(51) Int. Cl.

| | |
|---|---|
| ***H01T 13/39*** | (2006.01) |
| ***H01T 21/02*** | (2006.01) |
| ***B22F 3/16*** | (2006.01) |
| ***C22C 27/00*** | (2006.01) |

(52) U.S. Cl.

CPC ..... *H01T 13/39* (2013.01); *B22F 3/16* (2013.01); *C22C 27/00* (2013.01); *H01T 21/02* (2013.01); *B22F 2301/20* (2013.01)

(58) Field of Classification Search

CPC ..... H01T 13/54

See application file for complete search history.

(56) References Cited

U.S. PATENT DOCUMENTS

| | | | |
|---|---|---|---|
| 5,461,276 | A | 10/1995 | Matsutani et al. |
| 5,563,468 | A | 10/1996 | Abe et al. |
| 7,256,533 | B2 | 8/2007 | Landon |
| 7,508,121 | B2 | 3/2009 | Lykowski |
| 8,810,119 | B2 | 8/2014 | Shimizu et al. |
| 8,890,396 | B2 | 11/2014 | Ernst et al. |
| 9,083,155 | B2 | 7/2015 | Yoshizaki et al. |
| 9,800,023 | B2 | 10/2017 | Niessner et al. |
| 2012/0125279 | A1* | 5/2012 | Hampson ..... H01T 13/54 123/169 R |

(Continued)

FOREIGN PATENT DOCUMENTS

| | | | |
|---|---|---|---|
| CN | 104836120 | A | 8/2015 |
| DE | 69033451 | T2 | 6/2000 |

(Continued)

OTHER PUBLICATIONS

Office action issued by the German Patent and Trademark Office for application No. DE 10 2018 105 941.8.

(Continued)

*Primary Examiner* — Joseph L Williams
(74) *Attorney, Agent, or Firm* — Reising Ethington, P.C.

(57) ABSTRACT

A spark plug ignition tip for an electrode of a spark plug device, in particular a prechamber spark plug, having a base body that has a first axial end, a second axial end and a circumferential section situated between them; the base body contains a precious metal or precious metal alloy; the first axial end and/or the circumferential section is embodied for fastening the base body to an electrode; the second axial end has a dome-shaped section; and the base body is produced by powder metallurgy.

15 Claims, 3 Drawing Sheets

(56) References Cited

U.S. PATENT DOCUMENTS

| | | | |
|---|---|---|---|
| 2014/0261270 | A1 | 9/2014 | Burrows et al. |
| 2017/0170636 | A1 | 6/2017 | Niessner et al. |
| 2018/0287351 | A1 | 10/2018 | Niessner et al. |
| 2018/0369919 | A1 | 12/2018 | Burkhardt |

FOREIGN PATENT DOCUMENTS

| | | | |
|---|---|---|---|
| DE | 102010004851 | A1 | 6/2011 |
| DE | 102014015707 | A1 | 12/2015 |
| DE | 102015113175 | A1 | 9/2016 |
| DE | 102015121862 | A1 | 6/2017 |
| GB | 2302367 | A | 1/1997 |
| JP | 07211434 | A | 8/1995 |
| WO | 2017102858 | A1 | 6/2017 |

OTHER PUBLICATIONS

Office action issued by the German Patent and Trademark Office for application No. DE 10 2018 105 941.8 dated Apr. 30, 2019.
Informal Translation of Office action issued by the German Patent and Trademark Office for application No. DE 10 2018 105 941.8.

* cited by examiner

SPARK PLUG IGNITION TIP, SPARK PLUG DEVICE, AND METHOD FOR PRODUCING A SPARK PLUG IGNITION TIP

This application claims the benefit of German Application No. 10 2018 105 941.8, filed on Mar. 14, 2018, the contents of which are hereby incorporated by reference in their entirety.

FIELD

The present application relates to a spark plug ignition tip for an electrode of a spark plug device, in particular a prechamber spark plug, having a base body that has a first axial end, a second axial end and a circumferential section situated between them; the base body contains a precious metal or precious metal alloy; and the first axial end and/or the circumferential section is/are embodied for fastening the base body to an electrode.

The present application also relates to a spark plug device, particularly in the form of a prechamber spark plug, having an electrode onto which a spark plug ignition tip of the above-described type is mounted.

Finally, the present application relates to a method for producing a spark plug ignition tip.

BACKGROUND

A spark plug device similar to that described above is known, for example, from document DE 10 2014 015707 A1

This document discloses a prechamber spark plug that has a spark plug housing and a prechamber cap. The prechamber cap also includes a central transfer opening. The prechamber spark plug has a central electrode in the middle and a ground electrode device that at least partially encloses the central electrode in order to form a spark gap, the central electrode protrudes out from the ground electrode device.

Generally, prechamber spark plugs have a prechamber at the front end, with a spark gap positioned inside it. The prechamber is connected via openings to the actual combustion chamber. Such prechamber spark plugs can be used, for example, for igniting lean fuel mixtures, for example in gas-powered internal combustion engines. The prechamber in this case is a kind of pre-combustion chamber. Mixture flowing into the prechamber is ignited by means of an ignition spark. The flame that this produces in the prechamber is conveyed via the openings in the direction of the combustion chamber and ignites the lean mixture therein.

From document DE 10 2010 004851 B4, another prechamber spark plug is known in which cylindrical surfaces of a central electrode and a ground electrode undergo high-precision machining.

Document DE 10 2014 015707 A1 also discloses embodying the free end of the central electrode tip as concave. A fuel mixture flowing into the prechamber cap strikes the end of the central electrode tip and this generates turbulence. The generation of turbulence produces a flow in the front part of the prechamber, which contains a pronounced vertical directional component, which is directed toward the end of the prechamber cap and toward the central opening. In addition, lateral transfer openings are provided in the prechamber cap, through which mixture flows in, which causes a sharp pressure drop between a spark plug housing end of the spark gap and a prechamber end of the spark gap. This is intended to produce an improved "active" flushing of the electrode gap in the direction from the breathing space to the end of the prechamber 7.

SUMMARY

In this context, an object of the present application is to disclose an improved spark plug ignition tip, an improved spark plug device, and an improved method for producing a spark plug ignition tip.

The above object may be attained by means of a spark plug ignition tip for an electrode of a spark plug device, in particular a prechamber spark plug, having a base body that has a first axial end, a second axial end and a circumferential section situated between them; the base body contains a precious metal or precious metal alloy; the first axial end and/or the circumferential section is embodied for fastening the base body to an electrode; the second axial end has a dome-shaped section; and the base body is produced by means of powder metallurgy.

The above object may also be attained by means of a spark plug device, in particular a prechamber spark plug, having an electrode onto which a spark plug ignition tip of the type according to the present application is mounted.

Finally, the above object may also be attained by a method for producing a spark plug ignition tip, in particular a spark plug ignition tip of the type according to the present application, with the following steps: preparation of a powder or powder mix composed of a precious metal or precious metal alloy; powder metallurgical forming of the powder or powder mix in the shape of a base body that has a first axial end, a second axial end, and a circumferential section situated between them; the first axial end and/or the circumferential section is embodied for fastening the base body to an electrode; and the second axial end is embodied so that a dome-shaped section is produced; and sintering of the base body.

The dome-shaped section of the base body makes it possible to use the spark plug ignition tip to force a reliable introduction of the mixture into the spark gap of the spark plug device, particularly in a prechamber spark plug.

Because the base body is produced by means of powder metallurgy, it is possible to achieve a dome shape in a comparatively inexpensive way.

In the spark plug device according to the present application, it is advantageous that the spark plug ignition tip with which it is equipped can be used to introduce a mixture into a spark gap, in particular, an annular spark gap.

Through a powder metallurgical forming of the ignition tip, it can be inexpensively brought into the prescribed shape. Then, the base body can be sintered in order to produce the spark plug ignition tip.

On the whole, the spark plug ignition tip can be used to achieve a reliable ignition of a gas mixture in the spark gap of a spark plug. In addition, a long service life is achieved, particularly taking into account the thermal suitability and the technical possibilities.

For the powder metallurgical forming of a powder or powder mix in the shape of a base body, known methods can be used such as dry pressing (one-sided isostatic or two-sided), isostatic hot pressing (HIP, hot isostatic pressing), wet pressing, extrusion or injection molding (MIM).

The object may be fully attained.

In a preferred variant of the spark plug ignition tip according to the present application, the dome-shaped section is embodied as convex.

The convex embodiment of the second axial end of the spark plug ignition tip, which in the installed state is preferably situated opposite from a central opening of a prechamber cap, can achieve an advantageous turbulence and an advantageous flow behavior inside the prechamber. A fuel mixture entering via the central opening is deflected radially outward by the dome shape and is conveyed directly into an annular gap of a prechamber spark plug when the spark plug ignition tip is installed in it. In other words, the flow passes through the annular gap starting from the front end of such a prechamber, i.e., the location of the central opening, in the direction toward a rear chamber section. This makes it possible to achieve the fact that the annular chamber is always filled with sufficient fuel mixture at the time of ignition.

In an alternative embodiment, the dome-shaped section is embodied as concave. When installed in a prechamber spark plug, this in turn causes a fuel mixture that is flowing in through a central opening to be deflected radially outward and then reversed in its flow direction so that in a frontal region of an annular gap, a so-called suction effect occurs, which draws a fuel mixture contained in the rear section of the chamber into the annular gap.

In this way, it is also possible to insure that there is always a sufficient quantity of fuel mixture present in the annular gap at the time of an ignition.

In general, the dome shape can be any raised area or recess relative to a plane that is oriented transversely to a longitudinal axis of the base body. The dome-shaped section can therefore assume the form of a polyhedron, for example a pyramid. It is also conceivable for the dome-shaped region to be embodied in the form of an ellipsoidal segment, or the like.

It is particularly preferable, however, if the dome shape of the second axial end is embodied in the form of a spherical segment.

A spherical segment can be described by the formula $$(r-h)^2+a^2=r^2 \quad (1),$$

where r is the radius of the thus-defined sphere, h is the height of the spherical segment, and a is the radius of the base circle of the spherical segment.

As the radius a of the base of the spherical segment, preferably a value is assumed that is less than a radius of a generally cylindrical circumferential section of the spark plug ignition tip. Preferably, the ratio of a to the radius R of the circumferential section is in a range from 0.65:1-0.95:1.

In such a preferred variant, an annular gap is thus formed between the circumferential surface and an outer circumference of the spherical segment shape, which annular gap is oriented transversely, in particular perpendicularly, to a longitudinal axis of the base body.

The radius r of the spherical segment shape can be identical to the radius R of the circumferential section, but can also be smaller than the radius R. In general, the radius a of the base circle of the spherical segment is also preferably less than the radius r of the thus-defined sphere and/or less than a radius R of the circumferential section.

On the whole, it is also advantageous if the circumferential section is cylindrical and/or if the first axial end is embodied as a planar surface that is oriented transversely to a longitudinal axis of the base body.

By means of the cylindrical form, it is advantageously possible to establish a uniformly shaped annular gap for a prechamber spark plug.

By means of the planar embodiment of the first axial end, the spark plug ignition tip can be mounted on a central electrode in a structurally advantageous way, specifically by means of a suitable joining method such as laser welding, friction welding, etc.

The powder metallurgical production of the base body advantageously makes it possible for a complex shape of the spark plug ignition tip to be achieved in a favorable way, with a planar surface at one axial end and a dome shape at the other axial end. This even applies to materials that are comparatively difficult to machine, such as iridium alloys, in particular an iridium alloy of the kind described below.

In general, the base body can be composed of multiple parts, for example with a core and a shell that are made of different materials, with the shell preferably containing a more precious metal than the core.

It is preferable, however, for the base body to be composed of one piece.

In this way, the base body can be produced with comparative ease by means of a powder metallurgical method, in particular powder metallurgical forming with subsequent sintering.

By and large, it is also advantageous if the precious metal is iridium or if the precious metal alloy contains iridium.

In this case, it is particularly advantageous if the base body contains more than 50% by weight iridium.

Iridium is therefore preferably the main ingredient of the base body.

It is advantageous if the base body contains a precious metal alloy that includes iridium as the main ingredient as well as rhodium in a proportion of greater than 0% by weight and less than 20% by weight, preferably greater than 0% by weight and less than 10% by weight, and optionally zirconium oxide.

As described above, it is also advantageous if the base body as a whole is formed by means of powder metallurgy and then sintered.

In this connection, it is advantageous if the base body has a sintering density of greater than 96% and preferably less than 99.5% and/or if the base body has a porosity of greater than 4% and preferably less than 20%, in particular less than 10%, and/or if the base body has a sintering grain size that is less than or equal to 50 μm and greater than or equal to 5 μm.

In the spark plug device according to the present application, it is advantageous if the electrode is a central electrode; the spark plug ignition tip is mounted to an end of the central electrode; and an annular electrode at least partially encloses at least an axial section of the spark plug ignition tip so that between the spark plug ignition tip and the annular electrode, an annular gap is formed via which a spark exchange can take place.

In the spark plug device according to the present application, it is also advantageous if the dome-shaped section protrudes at least partially out from the annular electrode in the axial direction.

Naturally, the features described above and the features to be described in greater detail below can be used not only in the respectively indicated combination, but also in other combinations or by themselves without going beyond the scope of the present invention.

DRAWINGS

Exemplary embodiments are shown in the drawings and will be explained in greater detail below. In the drawings.

DESCRIPTION

Figure 1:
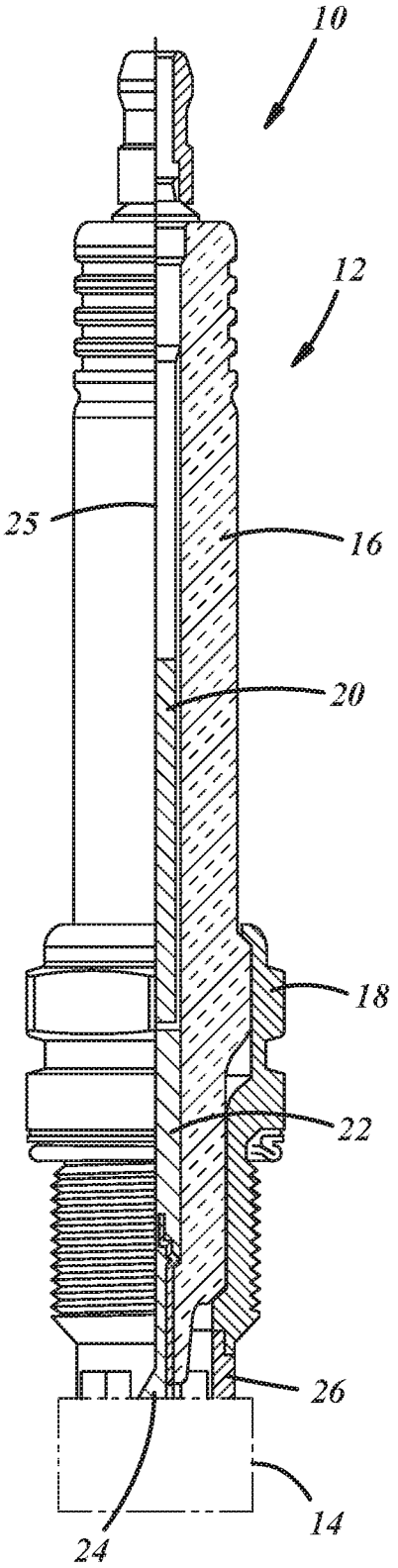
FIG. 1 is a schematic depiction of a spark plug for a motor vehicle, with a schematically indicated ignition section.

FIG. 1 schematically depicts a spark plug device that is generally labeled reference numeral 10.

The spark plug device 10 has a spark plug body 12, which has an ignition section 14 embodied at its front end.

The spark plug body 12 includes an insulator 16 around which a metal sleeve 18 is positioned. The metal sleeve 18 is generally equipped with a thread by means of which the spark plug device 10 can be screwed into a cylinder head of an internal combustion engine.

Centrally inside the insulator 16, an electric connection element 20 is provided, which extends through the spark plug body 12 in the axial direction so that at an end of the spark plug body 12 axially opposite from the ignition section 14, a spark plug connector can be slid on, via which electrical energy for producing ignition pulses can be provided.

On the inside of the insulator 16, the connection element 20 is electrically connected to a connecting element 22, which is in turn electrically connected to a central electrode 24 that extends out from the insulator 16 in the axial direction and along a general longitudinal axis 25, into the ignition section 14 that is schematically depicted in FIG. 1.

FIG. 1 also shows that the metal sleeve 18 is electrically connected to a ground electrode 26, which likewise extends into the ignition section 14.

Figure 2:
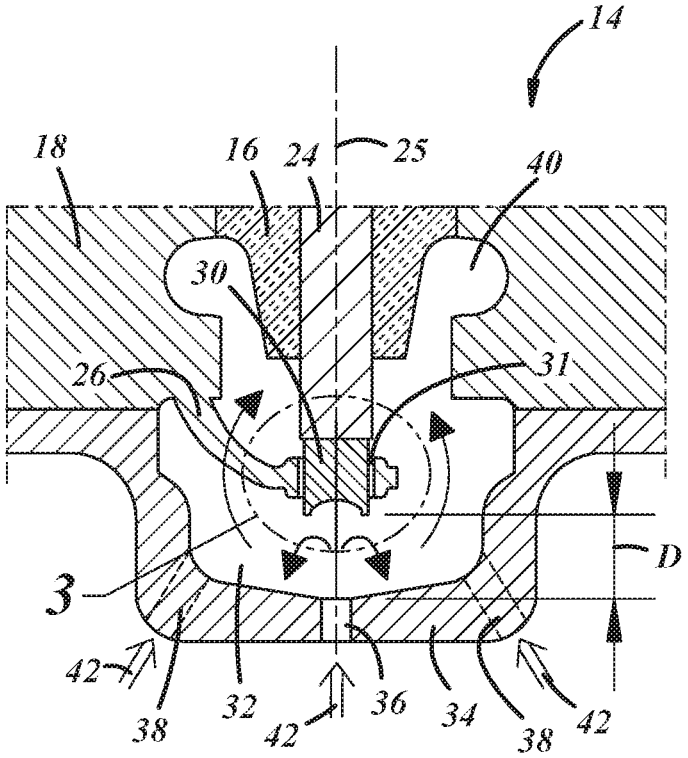
FIG. 2 shows an embodiment of an ignition section for the spark plug from FIG. 1.
Figure 3:
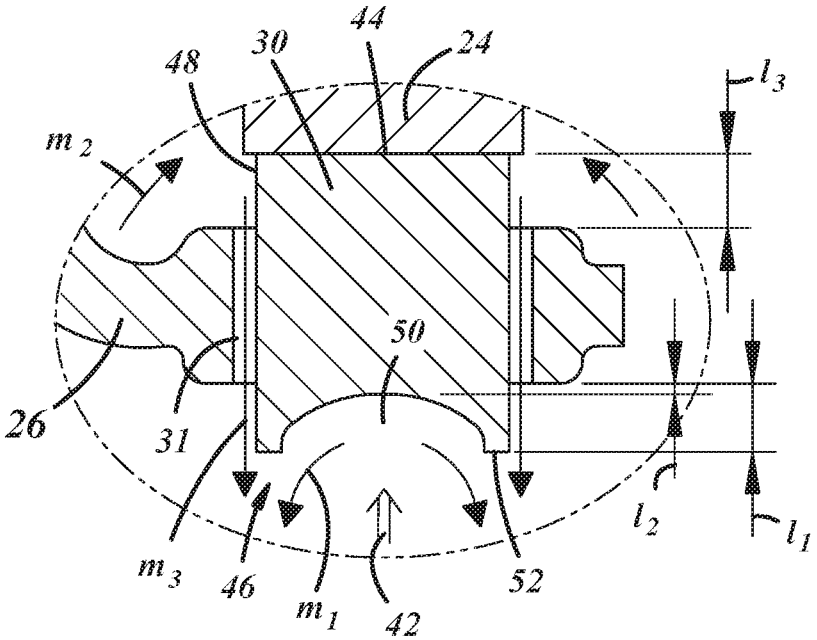
FIG. 3 is a detailed view III of FIG. 2.

FIGS. 2 and 3 show an embodiment of such an ignition section 14.

It is first of all apparent that the central electrode 24 extends out from a bore of the insulator 16 in the axial direction. At the front end of the central electrode 24, an ignition tip 30 is mounted, which is preferably at least partially made of a precious metal. The ground electrode 26 is embodied so that it extends at least partially around a circumferential section of the ignition tip 30 in such a way that an annular gap 31 is formed between the ground electrode 26 and the circumferential section of the ignition tip 30. The annular gap 31 constitutes a spark gap inside which a fuel mixture can be ignited.

The central electrode 24 with the ignition tip 30 mounted on it and the ground electrode 26 are positioned inside a prechamber 32 that is spatially delimited, specifically by the insulator 16 and metal sleeve 18 toward one axial end and by a prechamber cap 34 toward the other axial end, with the prechamber cap 34 being connected to the metal sleeve 18.

The prechamber cap 34 has a central opening 36 through which a fuel mixture can travel into the prechamber 32. The prechamber cap 34 also has multiple lateral openings 38 through which a fuel mixture 42 can also travel into the prechamber 32. In addition, an ignited fuel mixture or flame can travel out through the lateral openings 38 and the central opening 36.

A certain distance D is furnished between the central opening 36 and the ignition tip 30 that is positioned coaxial thereto. In an axial region between the ignition tip 30 and the insulator 16 or metal sleeve 18, a rear chamber section is furnished, which in particular has an annular chamber 40.

As is particularly shown in FIG. 3, the ignition tip 30 has a first axial end 44 that is embodied by means of a planar surface that is oriented perpendicular to the longitudinal axis 25. The ignition tip 30 is connected to the central electrode 24 via this second axial end 44, for example by means of a suitable joining method such as laser welding, friction welding, etc.

The ignition tip 30 has a second axial end 46, which is oriented toward the prechamber cap 34. Between the first axial end 44 and the second axial end 46, there is a cylindrical circumferential surface 48, which delimits the annular gap 31 on the radial inside.

The second axial end 46 has a dome-shaped section 50, which, in the present case, is embodied as concave. The concave dome-shaped section 50 is spaced apart from an outer circumference of the ignition tip 30 in such a way that radially outside the dome-shaped section 50, an annular surface 52 is formed, which is oriented perpendicular to the longitudinal axis 25.

The ignition tip 30 extends out from the ground electrode 26 in the axial direction. Stated more precisely, the ignition tip 30 protrudes from an axial end of the ground electrode 26 by a protrusion length $l_1$.

The dome-shaped section 50 has an axial depth relative to the annular surface 52 such that the axial surface of the ground electrode 26 is spaced apart from a deepest point of the concave dome-shaped section by a distance $l_2$ that is preferably greater than zero.

As is indicated by double arrows in FIG. 2, in a compression step, a fuel mixture, in particular a lean fuel mixture 42, enters the prechamber 32 through the central opening 36 and the lateral openings 38.

As is indicated particularly in FIG. 3, the fuel mixture entering through the central opening 36 is deflected radially outward by the concave dome-shaped section 50 and is redirected into a direction opposite from the influx direction. This is labeled $m_1$ in FIG. 3.

Furthermore, the lean fuel mixture that has been deflected in this way and fuel mixture that flows in through the lateral openings 38 travel in the axial direction toward the rear section of the prechamber 32, i.e. toward the annular chamber 40, which is labeled $m_2$ in FIG. 3.

Since the rear section of the prechamber 32 is delimited in the axial direction, the lean fuel mixture is then redirected into an axial direction again, specifically in such a way that it is forced through the annular gap 31 in the direction from the annular chamber 40 toward the central opening 36, labeled $m_3$ in FIG. 3. Because the fuel mixture flowing in through the central opening 36 is reversed in its flow direction, as indicated by $m_1$, a kind of negative pressure also occurs at this axial end of the annular gap 31, which further promotes a flow through the annular gap 31 in the direction toward the central opening 36.

The reliable flow through the annular gap 31 by the lean fuel mixture can assure that the lean fuel mixture is reliably ignited in an ignition by means of sparks arcing over in the region of the annular gap 31.

The forced "flushing" of the annular gap 31 also assures that heat occurring there can be dissipated relatively quickly so that the ignition section 14 as a whole can be embodied in a thermally stable and arc erosion-resistant way. This can result in an extended service life of the spark plug device 10.

Figure 4:
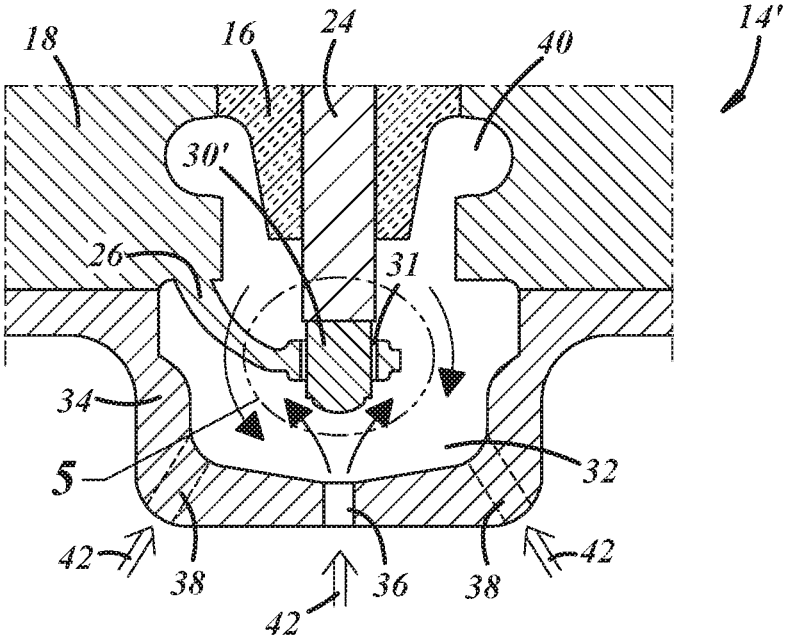
FIG. 4 shows an alternative embodiment of an ignition section for the spark plug from FIG. 1.
Figure 5:
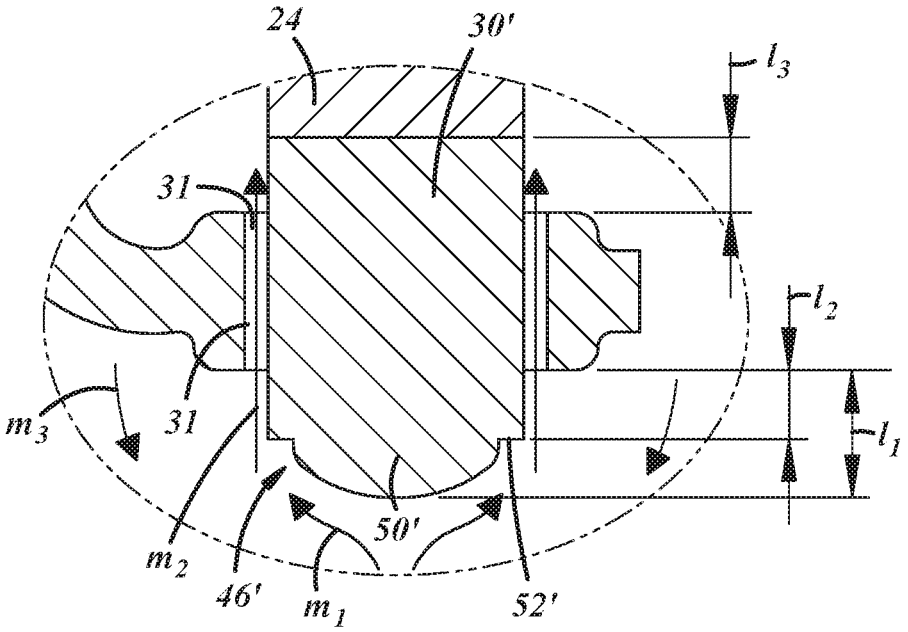
FIG. 5 is a detailed view V of FIG. 4.

FIGS. 4 and 5 show another embodiment of an ignition section 14'. In terms of its design and function, the ignition section 14' essentially corresponds to the ignition section 14 in FIGS. 2 and 3. The same elements have therefore been provided with the same reference numerals. Essentially, the differences will be explained below.

In the ignition section 14', the central electrode 24 is connected to an ignition tip 30' with a second axial end 46' having a dome-shaped section 50' that is embodied as convex. The convex dome-shaped section in this case is spaced apart from an outer circumference of the ignition tip 30' in such a way that an annular surface 52' is formed, which is oriented perpendicular to the longitudinal axis.

A fuel mixture 42 entering via the central opening 36 strikes the convex dome-shaped section 50' centrally and is deflected radially outward by it, but is not reversed in its direction as is the case with the concave dome-shaped section 50. The radial deflection outward is labeled $m_1$ in FIG. 5.

Due to the lack of a rotation direction reversal, the fuel mixture 42 flowing in is then conveyed into the annular gap 31 and flows through the latter in a direction starting from the central opening 36 toward the rear section of the prechamber 32. This is labeled $m_2$ in FIG. 5.

The gas mixture traveling into the rear section of the prechamber 32 is redirected there and travels back toward the prechamber cap 34, as is labeled $m_3$ in FIG. 5.

With the embodiment of an ignition tip 30' with a convex dome-shaped section, it is therefore also achieved that the annular gap 31 is subjected to good flushing in all operating phases so that essentially, the same advantages are achieved as with the concave dome-shaped section 50 from FIGS. 2 and 3.

Figure 6:
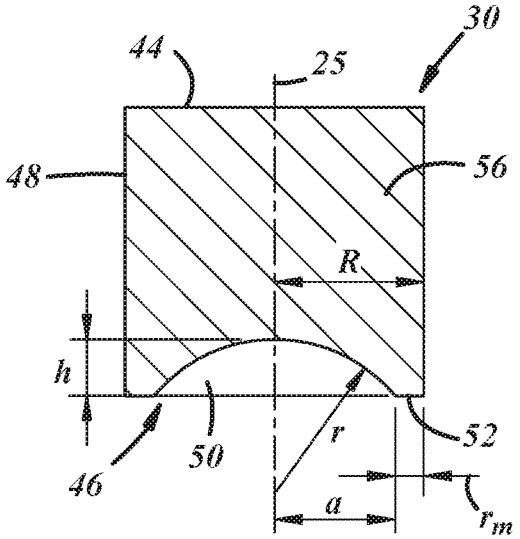
FIG. 6 is a schematic depiction of an embodiment of a spark plug ignition tip with a concave dome-shaped section.

FIG. 6 shows the ignition tip 30 from FIGS. 2 and 3. It is clear that the circumference surface 48 lies on a radius R relative to the longitudinal axis 25.

The dome-shaped section 50 is formed by a spherical segment, the base circle of which is aligned so that it is flush with the second axial end 46 and the annular surface 52. The radius of this base circle is labeled a in FIG. 6. The radius of the sphere that defines this spherical segment is labeled r in FIG. 6. Radius a is smaller than radius R. The radial magnitude $r_M$ of the annular surface 52 is calculated by means of $$r_M = R - a.$$

The depth of the dome-shaped section 50 is labeled h in FIG. 6.

For the spherical segment, the following formula applies:

$$(r-h)^2 + a^2 = r^2 \text{ or } h = r - \sqrt{(r^2 - a^2)}$$

In one embodiment, the value of R can be 1.35 mm. The value of r can be in a range from 1.5 mm to 6 mm. The value of $r_M$ can be in the range from 0.1 mm to 0.2 mm.

Preferably, r is equal to R.

The value of h is calculated based on the dimensions indicated above.

Figure 7:
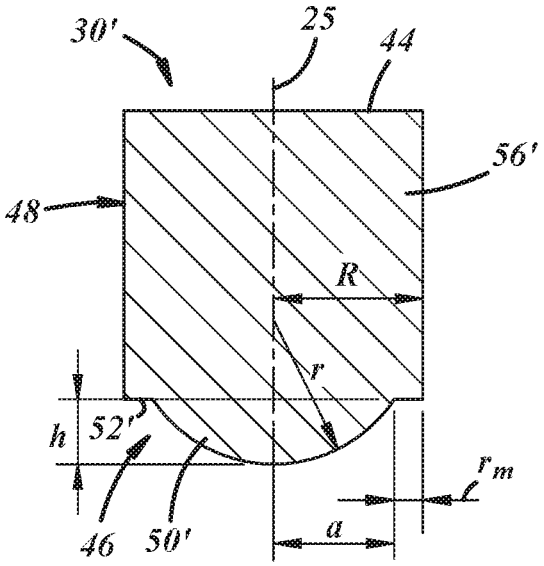
FIG. 7 is a schematic depiction of another embodiment of a spark plug ignition tip with a convex dome-shaped section.

FIG. 7 shows the ignition tip 50' from FIGS. 4 and 5. Here, the dome-shaped section 50' is embodied as a convex section that is likewise embodied in the form of a spherical segment. The calculation approaches indicated above apply equally with regard to the dimensions of the spherical segment.

In FIGS. 6 and 7, the ignition tips 50, 50' are each comprised of a one-piece base body 56 and 56'.

Figure 8:
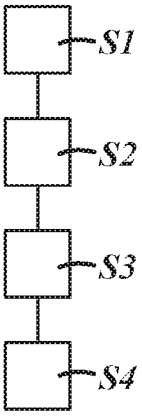
FIG. 8 is a flow chart of steps for performing an embodiment of a method for producing a spark plug ignition tip.

The base bodies 56, 56' can be produced using powder metallurgy. In this case, in particular, a method of the kind shown in FIG. 8 is used.

In a first step, a powder or powder mix composed of a precious metal or precious metal alloy is prepared (S1). In a second step, the powder or powder mix is formed into a shape of a base body 56 or 56' is formed by means of powder metallurgy (S2).

In a step S3, the base body 56, 56' is then sintered.

In a step S4, the base body 56, 56' can then be connected to an electrode, in particular a central electrode 24.

As a precious metal alloy, preferably a powder mix composed of an iridium alloy is prepared, the main ingredient of which is iridium. Preferably, the precious metal alloy contains iridium as its main ingredient and rhodium in a proportion of greater than 0% by weight and less than 20% by weight. The precious metal alloy can optionally also contain zirconium oxide.

In a preferred variant, rhodium is contained in a proportion of 2% to 3%, and zirconium oxide is contained in a proportion of approximately 50 to 200 ppm. The rest of the precious metal alloy is made up of iridium.

The sintering is carried out so that a sintering density of >96% is achieved at a porosity of greater than 4% and a sintering grain size of at most 10 μm.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug ignition tip for a central electrode of a spark plug device, in particular a prechamber spark plug, having:

a base body that has a first axial end, a second axial end, and a cylindrical circumferential section situated between the first and second axial ends, wherein the base body contains a precious metal or precious metal alloy;

the first axial end is embodied for fastening the base body of the ignition tip to the central electrode;

the second axial end is embodied for orientation towards a prechamber cap of the prechamber spark plug and has a dome-shaped section; and the base body is produced by powder metallurgy.

2. The spark plug ignition tip according to claim 1, wherein the dome-shaped section is convex.

3. The spark plug ignition tip according to claim 1, wherein dome-shaped section is concave.

4. The spark plug ignition tip according to claim 1, wherein the dome shape of the second axial end is a spherical segment.

5. The spark plug ignition tip according to claim 1, wherein the circumferential section is cylindrical and/or the first axial end is a planar surface that is oriented transversely to a longitudinal axis of the base body.

6. The spark plug ignition tip according to claim 1, wherein the base body is composed of one piece.

7. The spark plug ignition tip according to claim 1, wherein the precious metal is iridium or the precious metal alloy contains iridium.

8. The spark plug ignition tip according to claim 7, wherein the base body contains more than 50% by weight iridium.

9. The spark plug ignition tip according to claim 1, wherein the base body contains a precious metal alloy that includes iridium as the main ingredient as well as rhodium in a proportion of greater than 0% by weight and less than 10% by weight, and zirconium oxide.

10. The spark plug ignition tip according to claim 1, wherein the base body is sintered.

11. The spark plug ignition tip according to claim 10, wherein the base body has a sintering density of greater than 96% and/or the base body has a porosity of greater than 4% and/or the base body has a sintering grain size that is less than or equal to 50 μm and greater than or equal to 5 μm.

12. A spark plug device, in particular a prechamber spark plug, having the central electrode to which the spark plug ignition tip according to claim 1 is mounted.

13. The spark plug device according to claim 12, wherein the spark plug ignition tip is mounted to an end of the central electrode; and an annular electrode at least partially encloses at least an axial section of the spark plug ignition tip so that an annular gap is formed between them.

14. The spark plug device according to claim 13, wherein the dome-shaped section protrudes at least partially out from the annular electrode in the axial direction.

15. A method for producing a spark plug ignition tip for a central electrode of a spark plug device, in particular a prechamber spark plug, with the following steps:

preparing a powder or powder mix composed of a precious metal or precious metal alloy;

powder metallurgical forming of the powder or powder mix in the shape of a base body that has a first axial end, a second axial end, and a cylindrical circumferential section situated between the first and second axial ends;

the first axial end is formed so that it can fasten the base body of the ignition tip to the central electrode; and the second axial end is formed so that it can be oriented towards a prechamber cap of the prechamber spark plug and includes a dome-shaped section; and sintering of the base body.

* * * * *